United States Patent [19]

Howard, Jr.

[11] Patent Number: 4,850,494

[45] Date of Patent: Jul. 25, 1989

[54] BLOW MOLDED CONTAINER WITH SELF-SUPPORTING BASE REINFORCED BY HOLLOW RIBS

[75] Inventor: Carl R. Howard, Jr., Ypsilanti, Mich.

[73] Assignee: Hoover Universal, Inc., Ann Arbor, Mich.

[21] Appl. No.: 209,004

[22] Filed: Jun. 20, 1988

[51] Int. Cl.[4] ..... B65D 1/02

[52] U.S. Cl. ..... 215/1 C; 220/70

[58] Field of Search ..... 215/1 C; 220/69, 70, 220/72, 74

[56] References Cited

U.S. PATENT DOCUMENTS

| | | | |
|---|---|---|---|
| 3,403,804 | 10/1968 | Colombo | 215/1 C X |
| 3,598,270 | 8/1971 | Adomaitis et al. | 215/1 C |
| 3,871,541 | 3/1975 | Adomaitis | 215/1 C |
| 3,935,955 | 2/1976 | Das | 220/70 X |
| 4,108,324 | 8/1978 | Krishnakumar et al. | 220/70 X |
| 4,134,510 | 1/1979 | Chang | 220/70 X |
| 4,249,667 | 2/1981 | Pocock et al. | 215/1 C |
| 4,525,401 | 6/1985 | Pocock et al. | 220/70 X |
| 4,620,639 | 11/1986 | Yoshino | 215/1 C |

*Primary Examiner*—Sue A. Weaver

*Attorney, Agent, or Firm*—Harness, Dickey & Pierce

[57] ABSTRACT

A blow molded plastic container used in packaging of carbonated beverages having a hollow tubular body terminating at its lower end in an integral base. The base includes a frusto-conical shaped wall projecting into the hollow interior of the tubular body. The frusto-conical shaped wall terminates at a substantially planar wall. A plurality of ribs are formed radially about the base between the frusto-conical wall and the tubular body to thus form a plurality of symmetrical feet which support the container in an upright stable position.

4 Claims, 2 Drawing Sheets

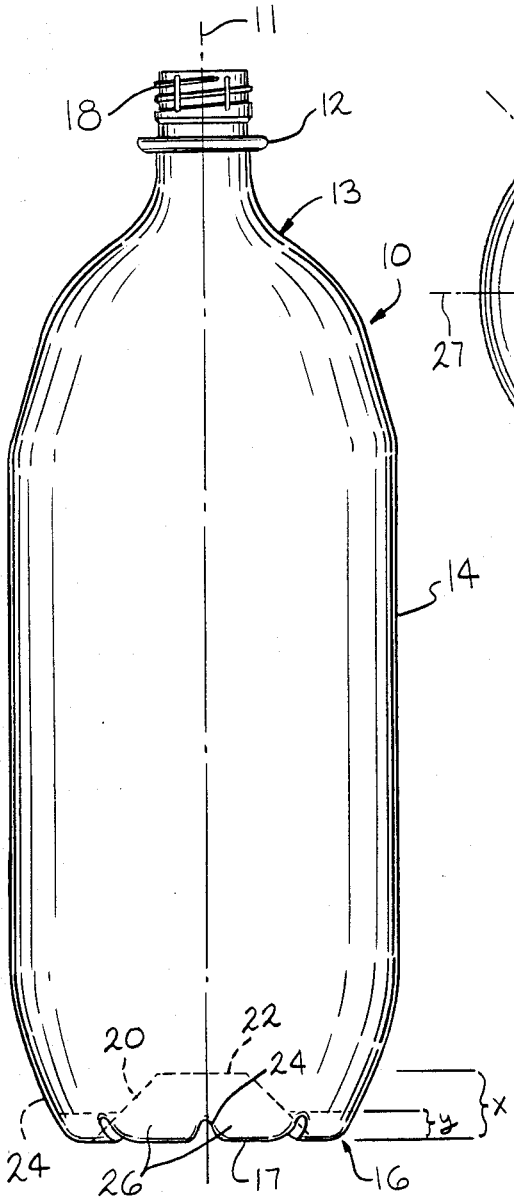
FIG. 1
FIG. 2
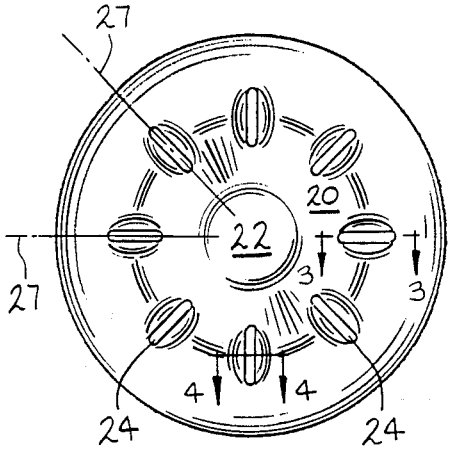
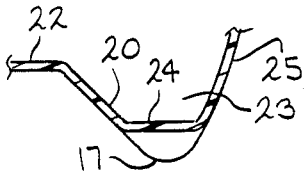
FIG. 3
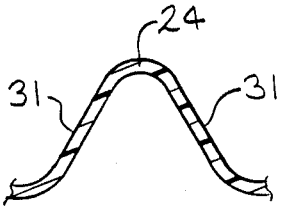
FIG. 4

BLOW MOLDED CONTAINER WITH SELF-SUPPORTING BASE REINFORCED BY HOLLOW RIBS

BACKGROUND AND SUMMARY OF THE INVENTION

The present invention relates to hollow plastic containers and, more particularly, to blow molded plastic containers with self-supporting bases. The base has sufficient strength to withstand internal pressures like those encountered in the packaging of carbonated beverages and the like, and in addition has distinct supporting feet which enable the container to stand without rocking.

With movement to plastic bottles for packaging carbonated beverages, the art has moved to plastic containers with self-supporting bases. Such a container must be able to withstand the internal pressure necessary to maintain the desired carbonation. Such a pressure is on the order of 75 p.s.i.

Several types of containers exist in the art that include integral bases with molded bottom configurations. These types of containers are illustrated in the following patents: U.S. Pat. Nos. 3,403,804, issued Oct. 1, 1968 to Colombo, entitled "Blown Bottle of Flexible Plastic"; U.S. Pat. No. 4,249,667, issued Feb. 10, 1981 to Pocock et al, entitled "Plastic Container with a Generally Hemispherical Bottom Wall Having Hollow Legs Projecting Therefrom"; U.S. Pat. No. 3,935,955, issued Feb. 3, 1976 to Das, entitled "Container Bottom Structure"; U.S. Pat. No. 4,108,324, issued Aug. 22, 1978 to Krishmakumar, et al, entitled "Ribbed Bottom Structure for Plastic Container"; U.S. Pat. No. 3,871,541, issued Mar. 18, 1975 to Adomaitis, entitled "Bottom Structure for Plastic Containers"; and U.S. Pat. No. 3,598,270, issued Aug. 20, 1971 to Adomaitis et al, entitled "Bottom End Structure for Plastic Containers". While these containers are known there still exists a need for a container of this type which requires a reasonable amount of material in the base, withstands internal pressures and will stand upright with out rocking.

The present invention provides the art with a container having a tubular body and an integral base, the junction of the two having a smooth, continuous exterior surface. The present invention eliminates any sharp bends deviations, or the like at the junction of the body and base. The present invention provides the container with good distribution of plastic throughout the container surface. Also, the present invention eliminates stress cracks and enables the use of a minimum amount of plastic material to mold the container. Also, when the container is full of a carbonated beverage or the like, the container will withstand the pressure necessary to maintain carbonation and will exhibit a very sturdy and rigid outer body. Once the beverage has been removed from the container, the container is very flexible and enables the container to be discarded and the plastic re-cycled.

Accordingly, the present invention provides an improved blow molded plastic container having the above advantages. The container includes a tubular body terminating at its lower end in an integral base. The base includes a truncated frusto-conical shape inner wall projecting into the interior of the tubular body. The frusto-conical shaped inner wall terminates at its upper end in a substantially planar top surface. Outwardly of the inner wall the container has a downwardly concave annular chamber bounded on the radially inner side by the inner wall of the base and on the radially outer side by the outer wall of the base. A plurality of ribs are formed radially about the base between the frusto-conical inner wall and the outer wall of the base. The ribs are in a plane below the planar top surface of the inner wall and form in the base a plurality of feet arranged in a circular formation and symmetrical with respect to the container axis. The feet are formed between the ribs and have a wide dimension in a direction circumferentially of the base to provide firm support for the container when standing.

From the subsequent description and claims taken in conjunction with the accompanying drawings, other objects and advantages of the present invention will become apparent to those skilled in the art.

BRIEF DESCRIPTION OF THE DRAWINGS

FIG. 1 is a side elevation view of a container in accordance with the present invention;

FIG. 2 is a bottom plan view of the container in FIG. 1;

FIG. 3 is an enlarged sectional view of a portion of the container as seen from substantially the line 3—3 in FIG. 2;

FIG. 4 is an enlarged sectional view of a portion of the container as seen from substantially the line 4—4 in FIG. 2;

DETAILED DESCRIPTION OF THE PREFERRED EMBODIMENT

Figure 5:
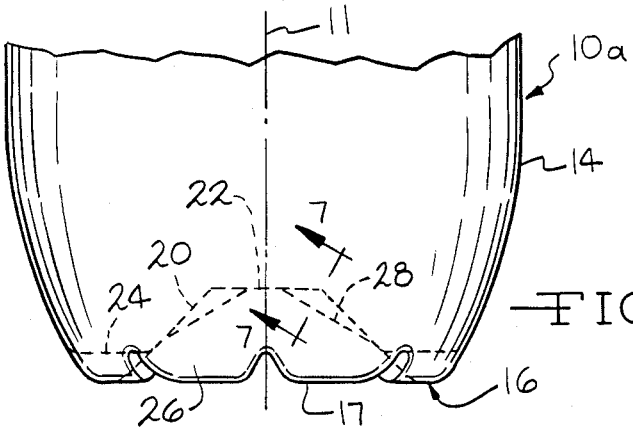
FIG. 5 is a fragmentary side elevational view of a modified form of container of the present invention.

With reference to the drawing, the blow molded plastic container of this invention is illustrated and designated generally at 10 in FIG. 1. The container 10 includes an integral tapered top portion 13 which includes a flange 12 and a threaded neck 18. The container also has a hollow tubular body 14 and an integral base 16.

The tubular thin wall body 14 is manufactured, as is the entire container, from a blow molded plastic material such as polyethylene terephthalate (PET). The container 10 is similar to that of U.S. patent application Ser. No. 208,899, filed June 20, 1988, entitled "Blow Molded Bottle with Self-Supporting Base", assigned to the assignee of the present application, the specification of which is herein incorporated by reference.

The base 16 includes a frusto-conical upwardly narrowing inner wall 20 and a substantially circular and planar wall 22 projecting into the interior of the hollow tubular body 14.

Outwardly of the inner wall 20, the container 10 has a downwardly concave annular chamber 23 bounded on the radially inner side by the wall 20 and on the radially outer side by the outer wall 25 (FIG. 3) of the base 16. A plurality of internal ribs 24 are formed in the base 16 between the walls 20 and 25, the ribs 24 being symmetrical relative to the longitudinal axis 11 of the container 10. A plurality of feet 26 are formed between adjacent ribs 24 to enable the container 10 to stand upright.

The ribs 24 are formed by elongated narrow indentations formed on the surface of the base 16 as seen in FIGS. 2–4 so that the ribs 24 extend radially of the base 16. The positioning of the ribs 24 is such that the ribs 24 are on radii about 30° to 60° apart and preferably about 45° apart, about the circular base.

The ribs 24 are of generally inverted V-shaped in cross-section when viewed transverse to the longitudinal axes of the ribs 24, as seen in FIG. 4. The intersection of the V, forming the ribs 24, along the ribs longitudinal axis 27 is somewhat planar, as seen in FIGS. 3 and 4.

The ribs 24 are all of substantially the same vertical height and are of small height so that they are all positioned well below the planar top wall 22. Thus, a ratio of the distance "x" from the rounded bottom 17 of the base 16 to the planar top wall 22 to the distance "y" from the bottom 17 to the top of the ribs 24 is about 3:1. The positioning of the ribs 24 below the planar top 22 enhances the strength of the container base 16. Also, the positioning of the ribs 24 enables the container 10 to stand level and to be relative to incidental tipping. The feet 26 also include angular side walls 31 that form the legs of the rounded, flattened inverted V-shape indentation of the ribs 24.

Figure 6:
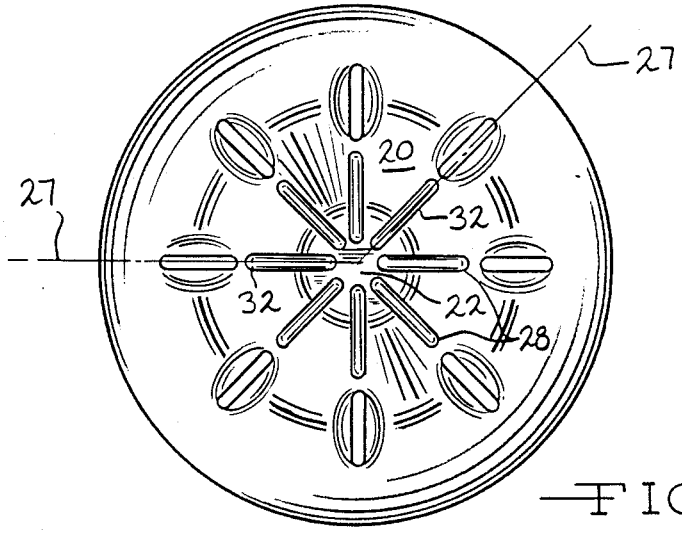
FIG. 6 is a bottom plan view of the container shown in FIG. 5.
Figure 7:
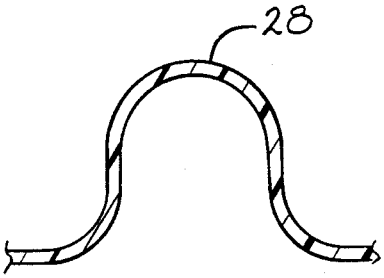
FIG. 7 is an enlarged sectional view of a portion of the container as seen from substantially the line 7—7 FIG. 5.

A modified form of the container of this invention is shown in FIGS. 5–7 and indicated generally at 10*a*. Like elements will be identified with the same references numerals.

The base 16 in the container 10*a* includes all of the structure in the base 16 in the container 10 and in addition includes a second set of reinforcing or stiffening ribs 28 (FIG. 6) as shown in FIG. 5. The ribs 28 are formed in the frusto-conical wall 20 and the top wall 22 and are located above the ribs 24. The ribs 28 are of an internal design having an overall U-shaped cross-section when viewed transverse to the rib's longitudinal axis 32, as shown in FIG. 7. Also, the ribs 28 may protrude from the base 16 and have a bulging inverted U-shaped configuration in cross-section when viewed transverse to the longitudinal axis 32 of the ribs 28. The ribs 28 are aligned with the ribs 24 in a direction radially of the base 16. Thus, the axes 27 and 32 of the ribs 24 and 28 are substantially coincident.

The ribs 28 add additional support and strength to the base 16 and prevent the generally concave bottom of the container 10a from inverting when filled with a carbonated beverage under a pressure of about 75 p.s.i.

While the above describes the preferred embodiment of the present invention, it will become apparent to those skilled in the art that modifications, variations, and alterations may be made to the present invention without deviating from the scope and fair meaning of the subjoined claims.

What is claimed is:

1. A blow molded plastic container comprising:

a hollow tubular body having a side wall of annular shape, and terminating at its lower end in an integral aligned base;

said base having a truncated frusto-conical shaped inner wall projecting upwardly into said hollow tubular body, a top wall at the upper end of said inner wall, and an annular downwardly concave chamber extending about said frusto-conical wall, said chamber having an outer wall which merges at its upper end with said tubular side wall and at its lower end with said frusto-conical wall to form a bottom surface, a plurality of radially extending hollow ribs formed in said bottom surface so as to extend upwardly therefrom a small distance so as to intersect said inner and outer walls at a position substantially below said top wall;

said bottom surface between said ribs forming a plurality of container support feet each of which is of substantial width in a direction circumferentially of said base relative to said ribs to provide firm support for said container, said ribs being symmetrically arranged relative to the longitudinal axis of said container to provide for a symmetrically uniform support of said cotainer on said feet without tipping of the container.

2. The container according to claim 1 wherein said feet formed between adjacent ribs have rounded sides and bottoms providing the container with a smooth continuous outer surface.

3. The container according to claim 2 further comprising a plurality of second hollow ribs formed in said base frusto-conical shaped inner wall and said top wall for further stifffening said base against deformation by internal pressure in said container.

4. The container according to claim 3 wherein said second ribs extend radially with respect to the longitudinal axis of said container.

* * * * *

UNITED STATES PATENT AND TRADEMARK OFFICE

CERTIFICATE OF CORRECTION

PATENT NO. : 4,850,494

DATED : July 25, 1989

INVENTOR(S) : Carl R. Howard, Jr.

It is certified that error appears in the above-identified patent and that said Letters Patent is hereby corrected as shown below:

Column 1, Line 16, after "With" insert --the--.

Column 3, Line 23, "relative" should be --resistive--.

Column 4, Line 34, "cotainer" should be --container--.
Column 4, Line 43, "stifffening" should be --stiffening--.

Signed and Sealed this

Twenty-fifth Day of December, 1990

*Attest:*

HARRY F. MANBECK, JR.

*Attesting Officer*

*Commissioner of Patents and Trademarks*